United States Patent [19]

Bridendall, Jr.

[11] 4,045,322

[45] Aug. 30, 1977

[54] CONNECTION MEANS FOR ANODE POSTS IN DIAPHRAGM CELLS

[75] Inventor: Philip R. Bridendall, Jr., Wilton, Conn.

[73] Assignee: Olin Corporation, New Haven, Conn.

[21] Appl. No.: 671,303

[22] Filed: Mar. 29, 1976

[51] Int. Cl.[2] ..... C25B 1/26; C25B 9/02

[52] U.S. Cl. ..... 204/263; 204/255; 204/286

[58] Field of Search ..... 204/95, 98, 128, 129, 204/252, 258, 266, 282, 283, 286, 288

[56] References Cited

U.S. PATENT DOCUMENTS

| | | | |
|---|---|---|---|
| 3,342,717 | 9/1967 | Leduc | 204/266 X |
| 3,591,483 | 7/1971 | Loftfield et al. | 204/286 X |
| 3,612,751 | 10/1971 | Adaev et al. | 204/286 X |
| 3,743,592 | 7/1973 | Metcalff | 204/286 X |
| 3,883,415 | 5/1975 | Shibata et al. | 204/258 |
| 3,891,531 | 6/1975 | Bouy et al. | 204/266 X |
| 3,954,593 | 5/1976 | Schmidt | 204/252 |

*Primary Examiner*—Arthur C. Prescott

*Attorney, Agent, or Firm*—Donald F. Clements; Thomas P. O'Day

[57] ABSTRACT

An improved means for connecting anode posts to diaphragm cell bases is described which utilized anode posts which are soldered at the lower end of each post in an opening in the cell base to provide a good electrical connection. A plastic sleeve is positioned on the anode post above the soldered connection, and sealed to the interior surface of the cell base to provide a liquid-tight seal.

8 Claims, 1 Drawing Figure

CONNECTION MEANS FOR ANODE POSTS IN DIAPHRAGM CELLS

Figure 1:
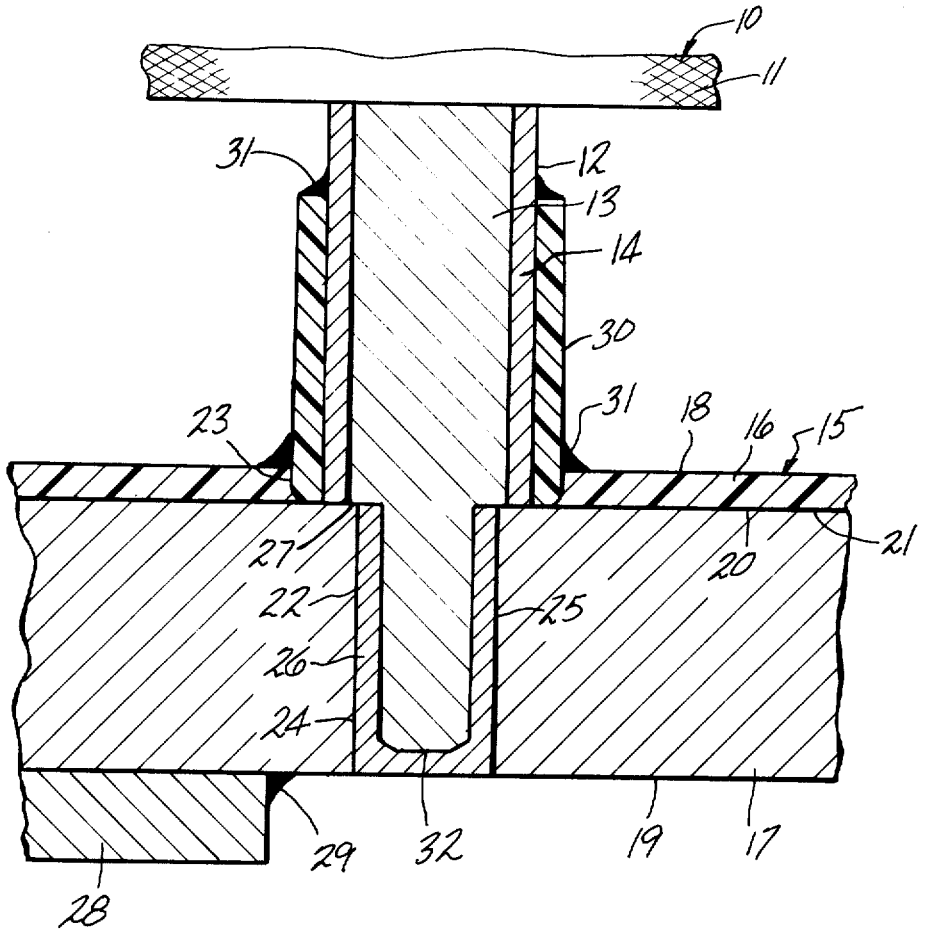

This invention relates to an electrolytic diaphragm cell having improved connection means for anode posts.

Electrolytic cells have been used extensively in the preparation of chlorine and caustic by the electrolysis of brine in a number of different cell designs. One of the problems in all of these designs is how to provide a satsifactory means for conducting current from the ambient side or exterior surface of the electrolytic cell, through the cell base or wall to the anodes of the cell.

One type of cell design, the electrolytic diaphragm cell is typically constructed of a steel cell can or body, a concrete top, and a concrete base. Graphite anodes are secured with lead and an asphaltic sealer in the cell base, and steel mesh cathodes coated with an asbestos diaphragm are suspended from the side of the cell body. Recently the graphite anodes have been replaced by metallic electrodes having a suitable conducting coating on the outer surface of the anodes. It is preferable not to use lead as the major support for these metallic anodes as in prior art techniques because its poor conductivity, its softness and its potential for environmental contamination. To improve electrical connections of these new metallic anodes, the structure of the conventional electrolytic diaphragm cell had to be modified in order to permit an improved installation of the dimensionally stable anodes.

U.S. Pat. No. 2,799,643, issued to C. W. Raetzsch on July 16, 1957, discloses a cell design for passing current to anodes secured to the sides of the cell container. This patent discloses cell bodies constructed of various non-conductive materials such as rubber covered steel.

U.S. Pat. No. 3,591,483, issued July 6, 1971, to Loftfield et al, describes a cell modification in which the cell base is a laminate of an electrically non-conductive sheet covering a metallic conducting and supporting cell base. Holes for receiving anode posts are formed in the non-conductive sheet and cell base and threaded anode posts are extended through the holes and secured to the cell base with threaded nuts and a suitable washer. The holes in the sheet are larger than the anode post.

U.S. Pat. No. 3,891,531, which issued on June 24, 1975, to Bouy et al, describes a technique for securing anode posts to conductive cell bases employing either a flanged anode post with a threaded bottom which extends through the cell base, or an anode post having an outside diameter equal to or larger than the diameter of the opening in the cell bottom at operating conditions, with internal channels in the lower portion of the anode post for conducting nitrogen gas for freezing the lower portion of the post to reduce its diameter prior to inserting it into the opening in the cell base. Subsequent expansion of the lower portion of the anode post provides a friction type liquid tight seal.

Although designs such as these represent an improvement over conventional concrete electrolytic cells, one of the problems encountered in the use of presently available anode post designs is the limited period of good electrical conductivity obtainable with threaded connections in a corrosive atmosphere. Likewise, the utilization of anode posts having internal channels for liquid nitrogen is a relatively expensive and cumbersome means of obtaining a liquid tight seal in electrolytic diaphragm cells.

There is a need at the present time for an improved means for connecting anode posts to electrolytic diaphragm cells.

It is a primary object of this invention to provide an improved electrode connection for electrolytic diaphragm cells, while maintaining a liquid-tight seal in the base of the cell.

Another object of the invention is to provide an improved electrolytic diaphragm cell in which anodes can be easily replaced or positioned within the cell.

Still another object of the invention is to provide a novel means for connecting anode posts in electrolytic diaphragm cells.

These and other objects of the invention will be apparent from the following detailed description thereof.

It has now been discovered that the foregoing objects of the invention are accomplished in an electrolytic diaphragm cell comprised of a cell base having a cell body secured thereto, said cell base having a conducting layer forming an exterior surface and an interior layer forming an interior surface, an interface between the conducting layer and the interior layer, a plurality of diaphragm-coated cathodes secured to said cell body, a plurality of anodes, each of said anodes being comprised of a metallic conductive surface secured to an anode post, each of said anode posts being secured to said cell base, each anode being positioned adjacent and parallel to at least one cathode, said cell base having an opening for each of said anode posts, and current conducting means secured to said exterior surface of said cell base, characterized by the improvement which comprises:

a. anode posts having the lower end of each secured in one of said openings by solder positioned between said conducting layer and said anode post,
b. a plastic sleeve secured to the lower portion of each of said anode posts above the soldered connection,
c. sealing means between the plastic sleeve and the interior surface of the cell base to provide a liquid-tight seal, and protection from crevice corrosion and electrolytic attack.

FIG. 1 is sectional elevational view of one embodiment of the invention in which each anode post is secured by a solder connection to hold it in a separate opening which extends completely through the conducting layer of the cell base, and in which each anode post has a plastic elongated sleeve secured to the lower portion thereof.

More in detail, FIG. 1 shows anode 10 comprised of metal surface 11 and anode rod 12. Metal surface 11 may be a solid sheet, mesh or other suitable anode form comprised of a titanium base coated with at least one metal and/or metal oxide of a platinum group metal such as platinum or ruthenium oxide. However, other suitable metals, metal oxides, and mixtures thereof useful as these metal surfaces are well known in the art.

Anode rod 12 is comprised of core 13 clad with exterior sheet 14. Usually anode core 13 is constructed of aluminum, copper, iron, steel, and the like and is clad with an exterior sheet 14 of corrosion resistant metal such as titanium. Although titanium is generally utilized for exterior sheet 14, other suitable metals of construction which resist corrosion by the electrolyte include tantalum, columbium, and zirconium.

Cell base 15 is a laminated cell base comprised of an upper interior layer 16 secured to a lower conducting layer 17.

Interior layer 16 has an interior surface 18 which serves as the floor of the cell to contain the electrolyte. Interior layer 16 is generally a non-metallic corrosion resistant material such as rubber, polyethylene, chlorinated polyvinyl chloride, polypropylene, acrylonitrile-butadiene-styrene polymers (ABS), polytetrafluoroethylene (PTFE), polyvinylidene fluoride polyester (PVFP), fluorinated ethylene propylene (FEP), ethylene chlorotrifluoroethylene (E-CTFE), mixtures thereof and the like. The use of fiber reinforcement, such as fiber glass, in the material used to form interior layer 16 is satisfactory, but hard rubber is the preferred composition of interior layer 16. A sheet of fluorinated ethylene propylene (FEP) sold commercially under the trademark "TEFLON FEP" by the duPont Company or a coating of polyvinylidene fluoride polyester sold commercially under the trademark "KYNAR" by the Pennwalt Corporation may also be used as interior layer 16.

Lower conducting layer 17 has an exterior surface 19, and is constructed of aluminum, copper, iron, alloys of at least one of these metals, and the like. Copper is preferably used as conducting layer 17, which may be joined at conducting layer top 20 with a suitable cement (not shown) to form interface 21 with interior layer 16 which provides a corrosion resistant bond over substantially the entire area of contact between interior layer 16 and conducting layer 17. Exterior surface 19 is generally exposed to the atmosphere.

A separate opening 22 is formed in cell base 15 for receiving each anode post 12. In the embodiment of FIG. 1, opening 22 is comprised of interior layer opening 23 in interior layer 16 and conductive layer opening 24 in conducting layer 17. Conducting layer opening 24 extends from conducting layer top 20 downwardly along walls 25 through conducting layer 17 to exterior surface 19. Walls 25 of conductive layer opening 24 provide adherent surfaces for solder 26 to secure anode posts 12.

The portion of anode post 12 which extends into opening 22 has exterior sheet 14 removed, exposing core 13 to solder 26 for better adhesion of solder 26. Generally any soft solder is suitable solder for securing anode post 12 to conducting layer 17. A typical suitable solder is comprised of from about 25 to about 60 percent tin by weight, the balance being lead and traces of other metals. Another suitable solder contains about 95 percent tin, and about 5 percent silver.

A flanged face 27 is formed on the lower portion of anode post 12 to provide a seat for anode post 12 to rest on conducting layer top 20.

Conductor 28 is secured by conductor welding 29, bolts (not shown) or otherwise in order to provide a strong electric contact with the bottom of conducting layer 17. Conductor 28 is preferably constructed of copper, but other materials such as aluminum may be used, if desired.

In FIG. 1, elongated plastic sleeve 30 is force fitted onto anode post 12 placed against conducting layer top 20. Plastic seals 31 are applied between anode post 12 and plastic sleeve 30 and between interior surface 18 and plastic sleeve 30 to provide a liquid-tight seal in the cell base. In addition, sealing also inhibits crevice corrosion and electrolytic attack upon anode post 12. Sleeve 30 is positioned concentric with opening 23, and preferably has an outside diameter corresponding to the diameter of opening 23. Sleeve 30 is preferably constructed of neoprene but may also be one of the same materials defined alone for interior layer 16, provided a liquid-tight seal can be obtained with plastic seal 31 between the material used for interior layer 16 and the material used for plastic sleeve 30.

In another embodiment of the invention plastic sleeve 30 may be constructed of a suitable plastic material which is shrinkable when subjected to temperatures obtained during the solder operation. For example, certain polyvinyl chlorides and polyethylene polymers as well as co-polymers of polyethylene with chlorotrifluoroethylene may be used as plastic sleeve 30. These shrinkable polymers when heated to temperatures of above about 300° F. will shrink to form a liquid-tight seal between plastic sleeve 30 and anode post 12.

The thickness of plastic sleeve 30 depends on the size of the anode post 12 and interior layer opening 23. Generally, the thickness of sleeve 30 may range from about 1/32 to about ¼ inch. The height of the sleeve depends upon the height of the anode posts 12 from conducting layer top 20 to the bottom of metal surface 11. Generally, the height of the sleeve 30 ranges from about 50 to about 100 percent of this distance. For example, when this distance is about 2 inches the height of sleeve 32 ranges from about 1 to about 2 inches.

Installation of the anode posts in the cell base is generally effected one anode post at a time. During the installation, cell base 15 preferably is inverted with exterior surface 19 facing upwardly and the cell base to positioned high enough above the floor to permit installation of anodes 10 from below. Anode 10 with metal surface 11, anode rod 12 and plastic sleeve 30 is placed on the interior of the cell with tip 32 directed upwardly and positioned in one cell base opening 22, with flanged face 27 pressed securely against conducting layer top 20 in a suitable jig (not shown). As indicated above, plastic sleeve 30 is positioned concentric with opening 23.

The space between wall 25 and anode post 12 is filled with a suitable solder. A high intensity heat source, such as an electric current, is then applied to tip 32 for a short period of time in order to fill the space with molten solder (which on cooling forms a sound joint) without damage to interior layer 16. For example, the surfaces to be soldered are heated to a temperature of about 450° F for a maximum of about 60 seconds.

After removal of the heat source, the solder is allowed to cool, while maintaining flanged face 27 securely against conducting layer top 20. The resulting sound electrical joint between the anode post and the cell base is a very efficient connection. A suitable cement is 31 is applied to plastic sleeve 30 and interior layer 16 to form a liquid tight seal between plastic sleeve 30 and interior layer 16. If desired, this sealing may be effected after all the anode posts 12 have been secured to cell base 15 by soldering and the cell base is reverted to its upright position.

It will be recognized by those skilled in the art that the embodiments presented in the drawing can be modified wherein the opening for each anode post in conducting layer 17 may not extend completely through the cell base, if desired.

If desired, a small key, (not shown) may be secured to the lower portion of each anode post for fitting into a corresponding key-way in each opening 24 in order to improve the uniformity of position of anode posts 12 in openings 24. Alternatively, the key may be positioned in opening 24 and the key-way in the side of the lower portion of anode posts 12.

If during the course of refurbishing the cell it is necessary to replace anode 10, solder 26 is melted, and anode 10 is withdrawn from the cell for removal of metal surface 11. Another anode 10 may be installed in place of the one removed.

The number of anodes 10 in the cell will usually correspond to the number of diaphragm-coated cathodes in the cell. The electrodes are positioned in the cell alternately, generally in a vertical position, with one anode being next to and spaced apart from a cathode. The cathodes are generally secured to the side of the cell and the anodes are positioned with anode posts 12 in at least one substantially straight row across the cell base 15. The number of anodes in each row and the number of rows of anodes, which corresponds to the number of conductors 28 in each cell, is not critical. Generally, the number of anodes in a row may range from about two to about 50 and preferably from about 10 to about 35 anodes per row. The number of rows of anodes (or conductors 28) may range from one to about 10 and preferably from about one to about six rows of anodes per cell. In a cell of this type, chlorine is produced at the anode, hydrogen is produced at the cathode, and each gas is collected separately.

Conductor 28 is generally a copper bar having a rectangular-shaped cross section, which is generally an extension of the bus bar from an adjacent cell. If desired, in order to provide a substantially uniform current distribution in anode posts 12 extending throughout each straight row of anode posts, conductor 28 is tapered to provide decreasing thickness from the first anode post 12 in a given row to the opposite side of cell base 15. As a result, when conductor 28 is secured to a power source such as an operative bus bar, and current is fed to conductor 28, a relatively uniform current distribution is achieved in anode posts 12 in each straight row across cell base 15.

The relative thickness of interior layer 16 and conducting layer 17 may also be varied with the size and shape of the electrolytic diaphragm cell. In a typical cell design, interior layer 16 is about ¼ inch thick and conducting layer 17 is about 1 inch thick. However, the thickness of interior layer 16 may range from about ⅛ to about 1 inch, and the thickness of conducting layer 17 may range from about ½ inch to about 2 inches or more. Thicknesses which provide the desired degree of support without undue expense are usually employed.

Various modifications may be made in the invention wihout being outside the scope of the invention. For example, anode rods 12 have been illustrated and described as being cylindrical in cross sectional area, but rectangular, square or other forms of cross sectional area may be used instead of cylindrical rods.

The novel anode connection of this invention may also be used in other electrolytic cells, such as the chlorate type, where the diaphragm is omitted and the product is sodium chlorate, or in cells where the anode connections are through the side of the cell. When a diaphragm is employed, it may be conventional asbestos, a mixture of asbestos and a resin such as the polyfluorocarbons described in U.S. Pat. No. 3,928,166, which issued Dec. 23, 1975, or cloth type membranes.

Advantages of using the novel conducting means and anode connection of this invention include the following:

1. Shortened anode posts 12 are less expensive than anode posts which extend through the cell base, with threaded extensions.

2. Good soldered electrical connections reduce power loss.

3. Improved seals reduce corrosion of cell base and anode posts by cell liquors.

4. Less expensive materials of construction and assembly means can be employed.

EXAMPLE

A diaphragm cell of the type disclosed in U.S. Pat. No. 2,447,547, issued to K. E. Stewart on Aug. 24, 1948, is modified to include the anode attachment means and the conductor attachment means of FIG. 1.

A cell base having an overall dimension of 63 inches by 56¼ inches is constructed of a 1-inch copper plate as conducting layer 17 coated with a ¼ inch thick hard rubber interior liner, as interior layer 16. Two series of anode posts holes are drilled in the cell base. Each series of holes is positioned in a straight line equidistant and parallel to the center line of the base about 14 inches from the center line and 28 inches from each other. The center line of the cell base is perpendicular to the 63 inch side of the cell. Each series of holes contains 16 holes, the centers of which are approximately 3 inches apart, the last hole in each series being approximately 4¾ inches from the edge of the cell base. The diameter of each hole is 1.125 inches.

Thirty-two anodes are placed in these holes, each anode being comprised of a mesh portion secured to the central anode posts having a neoprene sleeve of approximately ¼ inch thickness and about 1 inch high secured press fitted to the lower portion of the anode post. The mesh portion of each anode is approximately 24½ inches in width, 1¼ inches thick, and 18¼ inches in height, being secured at the center of its short dimension to an anode post having a diameter of approximately 1.125 inches. The length of these anode posts is approximately 27¾ inches and the upper edge of the mesh portion is located about ¾ inch from the top of the anode post.

Each anode post is constructed of a copper core clad with 0.04 inch thick tube of titanium on about the upper 2215/16 inch portion of the anode post. The titanium and a slight amount of copper is machined off of the base of each rod to leave a cylindrical copper base section ⅞ inches long by 1.115 inches in diameter. The face of the anode post above this section acts as a flange which contacts conducting layer top 20 and provides a seat for each anode post on the cell bottom.

Before assembly of the anodes into the cell base, the holes in the cell base are cleaned with caustic and acid in preparation for soldering. Flux and solder paste (50 percent tin - 50 percent lead) is placed in each hole and the anodes are inserted one at a time through the holes in the cell base. Before melting the solder a jig was set over the anodes to hold them in proper alignment, and to apply sufficient pressure to compress the neoprene sleeves. The entire assembly of cell base and jig was inverted and additional solder was added to fill all spaces between anode post and cell base. Heat is applied to each anode tip with a plasma jet flame at the base of each rod. The solder melted and flowed within about 30 seconds at each connection. The temperature-time exposure of the upper surface did not degrade the rubber liner or neoprene sleeve. Sealing of each neoprene sleeve 30 to the interior surface 16 was effected with neoprene cement to provide a liquid tight seal.

After all of the anodes were installed, the cell assembly was returned to an upright position, the jig was removed and the cell was placed on an insulated frame in an operating position. The cathodes and cell can are then placed on the cell base. Suspended from the two sides of the cell can are 30 asbestos coated steel mesh cathodes alternately spaced between and parallel to the anodes.

The cell operates for extended period with the minimum of maintenance and corrosion problems and with a high chlorine yield.

What is desired to be secured by Letters Patent is:

1. In an electrolytic cell comprised of a cell base having:

a. an interior layer which provides an interior surface, b. a conducting layer which provides an exterior surface, c. a cell body secured to said cell base, 1. a plurality of diaphragm-coated cathodes secured to said cell body, d. a plurality of anodes, each anode comprising:

1. a metallic conductive surface secured to 2. an anode post, said anode post being secured to said cell base, 3. each metallic conductive surface being positioned adjacent to and parallel to at least one of said cathodes, e. and current conducting means secured to said exterior surface, characterized by the improvement which comprises in combination, f. soldered connections between each of said anode posts and said cell base in said separate opening for each anode post in said cell base, and g. a plastic sleeve secured and sealed to the lower portion of each of said anode posts above said soldered connection, and h. liquid-tight sealing means between said anode post, said plastic sleeve and said interior layer for each of said anode posts, whereby inhibition of crevice corrosion and electrolytic attack upon said anode post is obtained.

2. The electrolytic cell of claim 1 wherein the tip of said anode post is within said opening.

3. The electrolytic cell of claim 2 wherein said plastic sleeve is secured to said anode post by a force-fit and sealing technique.

4. The electrolytic cell of claim 3 wherein said plastic is neoprene.

5. The electrolytic cell of claim 3 wherein said plastic is a heat shrinkable plastic.

6. The electrolytic cell of claim 4 wherein the wall of said plastic sleeve is secured by adhesive to said interior surface, whereby a liquid-tight seal is obtained between said neoprene sleeve and said interior surface.

7. The electrolytic cell of claim 3 wherein said anode post has a lower portion with a smaller diameter than the remainder of said anode post, the bottom of said remainder forming a second flange to seat each anode post above said opening in said conducting layer.

8. The electrolytic cell of claim 6 wherein said anode post has a lower portion with a smaller diameter than the remainder of said anode post, the bottom of said remainder forming a second flange to seat each anode post above said opening in said conducting layer.

* * * * *